United States Patent [19]

Stone

[11] Patent Number: 4,470,503

[45] Date of Patent: Sep. 11, 1984

[54] RETURNABLE BOTTLE CARRIER WITH STRAP HANDLE

[75] Inventor: Orison W. Stone, Middlebury, Vt.

[73] Assignee: Pack Image, Inc., Middlebury, Vt.

[21] Appl. No.: 501,507

[22] Filed: Jun. 6, 1983

[51] Int. Cl.[3] ..... B65D 5/46

[52] U.S. Cl. ..... 206/141; 206/167; 206/199; 206/200; 206/428; 206/434; 229/52 B; 229/52 BC

[58] Field of Search ..... 206/139, 141, 143, 167, 206/168, 169, 199, 200, 427, 428, 432, 434, 435; 229/40, 52 B, 52 BC

[56] References Cited

U.S. PATENT DOCUMENTS

| | | | |
|---|---|---|---|
| 2,662,684 | 12/1953 | Robins | 229/52 B |
| 2,811,250 | 10/1957 | Arneson | 206/434 |
| 3,090,520 | 5/1963 | Wuerthner | 206/158 |
| 3,348,672 | 10/1967 | Brown | 229/40 |
| 3,955,745 | 5/1976 | Forrer | 206/428 |
| 4,202,446 | 5/1980 | Sutherland | 206/427 |
| 4,256,226 | 3/1981 | Stone | 206/427 |
| 4,278,168 | 7/1981 | Wood | 206/427 |
| 4,300,680 | 11/1981 | Champlin | 206/141 |
| 4,314,634 | 2/1982 | Stone | 206/167 |
| 4,424,901 | 1/1984 | Lanier | 206/141 |

FOREIGN PATENT DOCUMENTS

| | | | |
|---|---|---|---|
| 1101345 | 1/1968 | United Kingdom | 206/141 |

*Primary Examiner*—George E. Lowrance
*Assistant Examiner*—Jimmy G. Foster
*Attorney, Agent, or Firm*—Wood, Herron & Evans

[57] ABSTRACT

A returnable bottle carrier wherein paperboard is substantially completely wrapped about the bottles to provide top, bottom, side and end walls. Two spaced parallel scores are cut in the top wall and partway down the end walls to create a strap. X-shaped creases are formed in the end portions of said strap to relieve stresses. Lateral portions of the top wall are perforated and creased so that they can be torn away from the top wall and pressed into the carrier, thereby opening up the carrier for removable and replacement of bottles.

3 Claims, 3 Drawing Figures

RETURNABLE BOTTLE CARRIER WITH STRAP HANDLE

This invention relates to a carrier for bottles such as a six-pack, and more particularly, the invention relates to the forming of the top and end walls in such a manner as to provide for a returnable carrier.

In U.S. Pat. No. 3,090,520, there is disclosed a carrier for six bottles. The carrier consists of a tube formed by a bottom wall, a top wall and two end walls. Bottles are side loaded into the tube, and then upper and lower side flaps are brought around the bottles to completely enclose the bottles except for the bottle crowns and caps which project throughout apertures in the top wall.

This type of carrier has been in use for many years and is particularly useful in packaging a beverage which should not be exposed to light over a very long period as, for example, beer which is contained in clear bottles.

Access to the bottles is usually attained by pulling up on the upper side flap. In the normal course of opening the carrier the structural integrity of the carrier is destroyed. The carrier thus is not really useful as a carrier for returnable bottles.

Over the past few years, for ecological reasons, there has been a greater emphasis on returning bottles after they have been emptied of their contents. A number of states have even passed laws preventing the sale of beverages in non-returnable or one-way bottles. To the extent that returnable bottles are sold in the carrier described above, the carrier presents a problem. Since removal of the bottles from the carrier for all practical purposes, requires the destruction of the carrier the bottles must be returned in another type of carrier as, for example, a paper bag. The consumer, who is used to carrying his returnable bottles in the basket-type carrier in which they are usually sold, may be reluctant to buy a product in a carrier which is not useful as other products having returnable carriers.

It has therefore been an objective of the present invention to improve the carrier described above so that it can be opened to remove the bottles while still retaining sufficient structural integrity to enable the carrier to be used for carrying returns.

The present inventor improved upon the above-identified carrier by providing a central brace to serve as a handle and to enable the carrier to be opened without destroying the carrier and to be used to return bottles. That improvement is disclosed in U.S. Pat. No. 4,256,226.

The disadvantage of that carrier is that the formation of the central brace requires additional paperboard and as a consequence is more expensive than the original carrier.

An objective of the present invention has been to provide a carrier which is no more expensive than the original carrier described above in that no additional paperboard is required, the carrier being suited for opening without destruction and use for returning returnable bottles.

The objective of the invention is attained by providing, across the top wall and down a portion of the end walls, two substantially parallel score lines from which a strap can be pulled away from the top and end walls for carrying the carrier. When the strap is separated from the top wall, it partially opens the top wall for access to the bottles within. The remainder of the top wall is perforated or scored so that it can be folded down along the side walls, thereby making the interior of the carrier completely accessible for the removal and return of the bottles.

A further objective of the invention has been to improve the strap described above to make it more resistant to tearing when the carrier containing filled bottles is subjected to lifting and twisting forces encountered during the normal carrying of the six-pack from place to place. The stress which tends to tear the strap occurs at those portions of the strap immediately adjacent the consumer's fingers when the fingers hold the strap. Secondarily, the stresses occur at the corners of the strap where the strap is connected to the end walls of the carrier.

The foregoing objective of the invention is attained by providing X creases extending from the lower corners of the strap to points aproximately one-fourth the distance between end walls. When the carrier is torqued or twisted with respect to the strap, the creases permit the portions of the strap on either side of the fingers to fold and to distribute the stresses along the strap and away from the stress points. The several features and objectives of the inventin will become more readily apparent from thefollowing detailed description taken in conjunction with the accompanying drawings in which:

Figure 1:
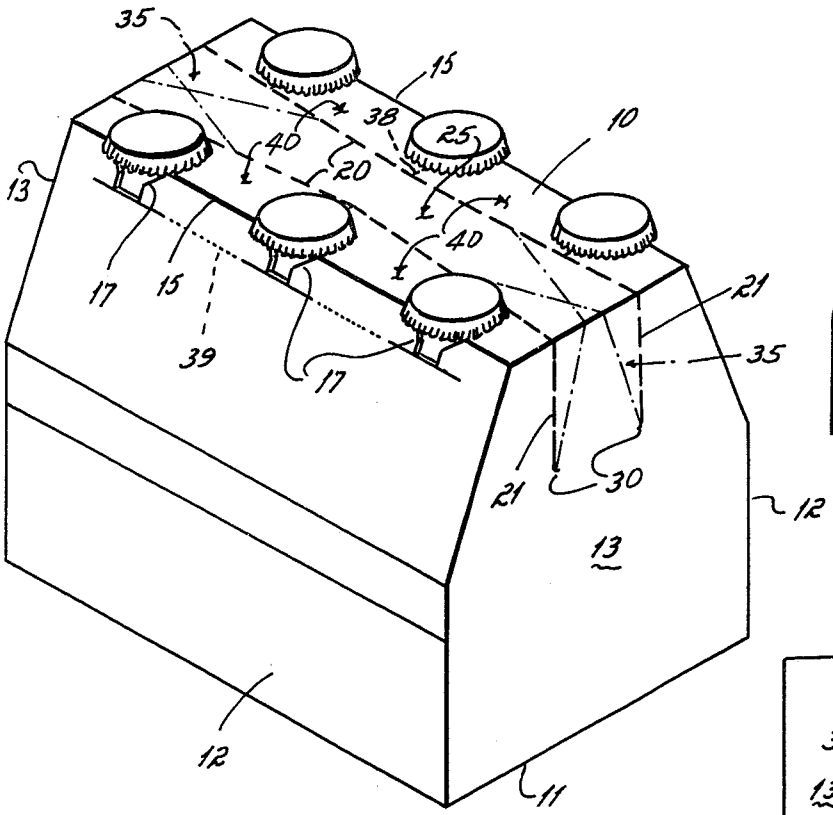
FIG. 1 is a perspective view of the carrier of the present invention.

Referring to FIG. 1, the carrier has a top wall 10, a bottom wall 11, side walls 12 and end walls 13. The top wall is joined to the side walls along corners 15. Spaced apertures 17 are formed along the corners and the necks of the bottles project through those apertures and maintain the bottles spaced from each other. The carrier thus far described is well known in the marketplace and is the subject of U.S. Pat. No. 3,090,520.

Figure 2:
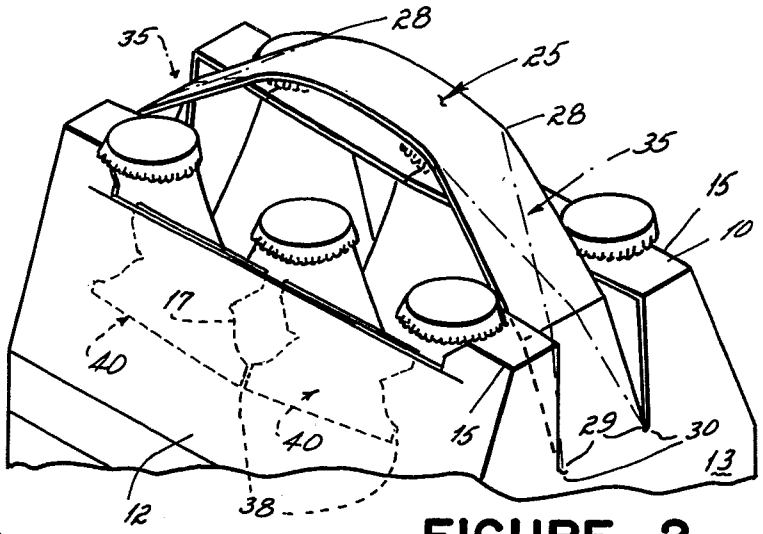
FIG. 2 is a fragmentary pespective view similar to that of FIG. 1 showing the strap in a carrying position and one portion of the top wall folded down for access to the bottles.

The improvement provided by the present invention consists in part by forming spaced parallel score lines 20 in the top wall and extensions 21 of the score lines in both end walls. The extensions extend into the end walls approximately two inches. The score lines form a strap 25 which can easily be pulled away from the top and end walls by a slight application of pressure to assume the attitude illustrated in FIG. 2.

When the strap 25 is pulled away from the top wall and gripped by the fingers of the consumer, the primary stress points occur at the places indicated by the arrows 28. Secondary stress points occur at the corners of the strap indicated at 29. To partially relieve the stress at the corner, the score lines 21 are terminated in arcuate slits 30. The principal relief from stress is provided by the X-shaped creases 35 on each end of the strap. The X-shaped creases extend from the corners 29 of the strap 25 to approximately the stress points indicated at 28 which are about two inches inward of the end walls 13.

When the carrier is gripped in the fingers of the consumer and twisted as by relatively violent swinging of the carrier with respect to the strap, it can be observed that the strap tends to fold upon itself along the X-shaped crease lines, thereby distributing the stress along the length of the strap between the corners 29 and the stress points 28. If the X-shaped creases were not there and thus the tendency of the strap to fold upon itself eliminated, there is a significant tendency of the strap to tear alongside the fingers of the consumer as well as at the end corners of the strap.

Figure 3:
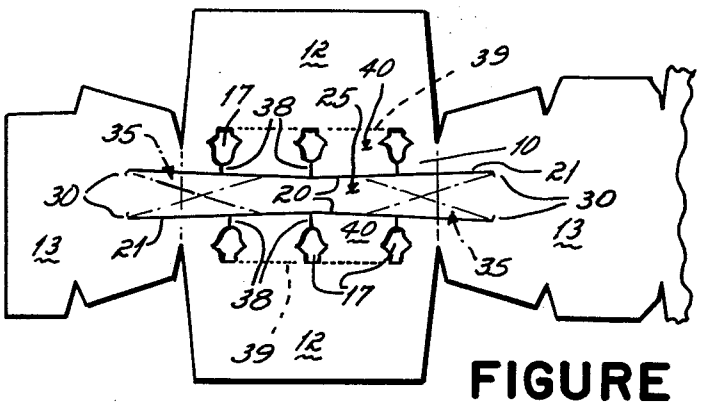
FIG. 3 is a plan view of a portion of the blank from which the carrier is formed.

As best shown in FIG. 3, the top wall has perforations 38 extending from each aperture 17 to the adjacent score line 20 by which the strap is formed. Each side wall is also creased or scored as indicated at 39. The perforations 38 and the creases 39 form four sections 40 in the top wall. By pressing slightly on any one of the sections, it can be folded down into the carrier to lie alongside a side wall. That, coupled with the lifting of the strap, opens the carrier for access to the bottles, thereby enabling the bottles to be removed and to be returned to the carrier without any destruction of the carrier as indicated at the left side of the carrier in Fig. 2.

In normal use, the purchaser would press upon the top wall alongside the strap 25 to break away the scores and insert the fingers underneath the strap 25. Pulling up on the strap lifts it to the orientation shown in FIG. 2 whereby the six-pack can conveniently be carried away from the store.

When the product is to be consumed, one or more of the sections 40 is pressed inwardly and folded along a respective side wall to open up the carrier for extraction of bottles. When the product is consumed, the bottle can be returned to the carrier and the carrier returned to the store for return of deposit.

The X-shaped creases in the strap enable the carrier to be handled quite roughly without any tendency of the strap to tear being minimized by virtue of the folding action along the X-shaped creases as described above.

Having described my invention, I claim:

1. In a paperboard carrier which is substantially completely wrapped about a pack of bottles and which presents a top wall and two end walls, a carrying strap comprising, two spaced parallel cut scores extending completely across the center of said top wall and down into the upper portion of each end wall, to create a strap, said strap terminating in corners at said end walls, X-shaped creases in said strap extending from said corners to points on the edges of said strap about one-fourth the distance inward from the top corner of said strap, said creases relieving stresses where the hand grips the strap and at said corners when said strap supports the weight of said carrier and bottles.

2. A paperboard carrier as in claim 1 in which said carrier has three spaced apertures along each side of said strap.

perforation lines extending between each aperture and said cut scores forming said strap, whereby said top wall on each side of said strap may be pressed and folded along the side wall of said carrier to provide access to said bottles.

3. A paperboard carrier as in claim 1 further comprising arcuate cuts at said lower corners of said strap to reduce tearing.

* * * * *